US011415297B2

(12) United States Patent
Loomis

(10) Patent No.: US 11,415,297 B2
(45) Date of Patent: Aug. 16, 2022

(54) SYSTEM AND METHOD FOR PROVIDING LIGHTING FOR VARIOUS VENUES

(71) Applicant: Seasons 4, Inc., Toano, VA (US)

(72) Inventor: Jason Loomis, Decatur, GA (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 16/947,958

(22) Filed: Aug. 25, 2020

(65) Prior Publication Data

US 2022/0065428 A1 Mar. 3, 2022

(51) Int. Cl.

| | |
|---|---|
| ***F21V 21/008*** | (2006.01) |
| ***F21S 4/10*** | (2016.01) |
| ***F21V 23/06*** | (2006.01) |
| ***F21V 23/00*** | (2015.01) |
| *F21Y 115/10* | (2016.01) |

(52) U.S. Cl.

CPC ..... *F21V 21/008* (2013.01); *F21S 4/10* (2016.01); *F21V 23/001* (2013.01); *F21V 23/06* (2013.01); *F21Y 2115/10* (2016.08)

(58) Field of Classification Search

CPC ..... F21V 21/008; F21V 23/06; F21V 23/001; F21S 4/10; F21Y 2115/10

See application file for complete search history.

(56) References Cited

U.S. PATENT DOCUMENTS

| | | | | |
|---|---|---|---|---|
| 5,106,661 | A | 4/1992 | Pitts, Sr. | |
| 6,651,938 | B1 * | 11/2003 | Moreland | F16L 3/1215 248/61 |
| 7,195,216 | B2 | 3/2007 | Wang | |
| 7,267,852 | B1 | 9/2007 | Rosado et al. | |
| 8,506,136 | B1 * | 8/2013 | Herdt | F21V 17/007 362/391 |
| 9,974,405 | B1 | 5/2018 | Conlin | |
| 10,578,260 | B1 * | 3/2020 | Chen | F21S 4/26 |
| 2006/0164831 | A1 * | 7/2006 | Lai | F21S 10/023 362/231 |
| 2007/0019441 | A1 * | 1/2007 | Moreland | F21V 21/34 362/648 |
| 2008/0074893 | A1 * | 3/2008 | Ham | F21V 21/16 362/387 |

(Continued)

FOREIGN PATENT DOCUMENTS

| | | | | |
|---|---|---|---|---|
| CA | 3090978 A1 * | 2/2021 | | A45B 23/00 |
| WO | WO-2021103637 A1 * | 6/2021 | | F21V 19/00 |

*Primary Examiner* — Tracie Y Green

(74) *Attorney, Agent, or Firm* — Kinney & Lange, P.A.

(57) ABSTRACT

Apparatus and associated methods relate to a lighting system configured to be suspended overhead between two supporting structures. A tensile force will be imparted to the lighting system as a consequence of suspending the lighting system overhead. The lighting system can include one or more lighting sections connected end to end. Each of the lighting sections has a structural support cable and a light string coupled thereto. Each of the lighting sections has first and second end connectors on first and second ends of the lighting section. The first and second end connectors provide mechanical connection between adjacent structural support cables as well as electrical connection between adjacent light strings. The lighting sections are configured such that the tensile force imparted to the lighting section is mostly borne by the structural support cable.

20 Claims, 5 Drawing Sheets

(56) References Cited

U.S. PATENT DOCUMENTS

| | | | | |
|---|---|---|---|---|
| 2009/0309504 | A1* | 12/2009 | Hsu | H05B 45/00 315/185 S |
| 2013/0280945 | A1* | 10/2013 | Chobot | H01R 13/66 439/360 |
| 2018/0299084 | A1* | 10/2018 | Chien | F21V 29/00 |

* cited by examiner

SYSTEM AND METHOD FOR PROVIDING LIGHTING FOR VARIOUS VENUES

BACKGROUND

Café light strings are strings of lights configured to provide lighting over an open expanse, such as, for example a grassy lawn or a patio. Various other types of light strings can also be configured to provide lighting over such open expanses. These café lights are usually configured as strings of lights suspended over the open expanse between securing structures. A distance between such securing structures can dictate the number of lights and the dimension of a string of such lights. Distances between securing structures at different venues will dictate different numbers of lights and different dimensions of strings of such lights, which are required for these different venues. Thus, every venue requires customized requirements for providing café lighting. An adaptable system for providing café lighting would facilitate installation of café lights in these various venues.

Some café lighting venues can be quite expansive. For such expansive venues, overhead suspension of strings of light can require high tension in support cabling. Should multiple strings of lights be required to span such large expanses, such high tension could cause uncoupling of mechanical and/or electrical connectors or other failures. Such failures can result in inhibiting power to café lights, destruction of the strings of café lights, or even injury to persons situated below the suspended café light strings. Reliable and secure mechanical and electrical connection of multiple strings is needed, especially for large venues.

SUMMARY

Apparatus and associated methods relate to a lighting section that includes a structural support cable and a light string. The structural support cable includes a first connecting member at a first end of the structural support cable. The first connecting member is configured to mechanically connect to a second connecting member of a second end of an adjacent upstream structural support cable. The structural support cable also includes a second connecting member at a second end of the structural support cable. The second connecting member is configured to mechanically connect to a first connecting member and a first end of an adjacent downstream structural support cable. The light string is coupled to the structural support cable so as to be extended along the structural support cable between the first and second connecting ends of the structural support cable. The light string includes a first electrical connector at a first end of the light string. The first electrical connector is configured to receive electrical power from a second electrical connector of an adjacent upstream café light string. The light string includes a second electrical connector at a second end of the light string. The second electrical connector is configured to receive electrical power to a first electrical connector of an adjacent downstream café light string. The light string also includes an electrical cable extending between the first and second electrical connectors.

DETAILED DESCRIPTION

Apparatus and associated methods relate to a lighting system configured to be suspended overhead between two supporting structures. A tensile force will be imparted to the lighting system as a consequence of suspending the lighting system overhead. The lighting system can include one or more lighting sections connected end to end. Each of the lighting sections has a structural support cable and a light string coupled thereto. Each of the lighting sections has first and second end connectors on first and second ends of the lighting section. The first and second end connectors provide mechanical connection between adjacent structural support cables as well as electrical connection between adjacent light strings. The lighting sections are configured such that the tensile force imparted to the lighting section is mostly borne by the structural support cable.

Figure 1:
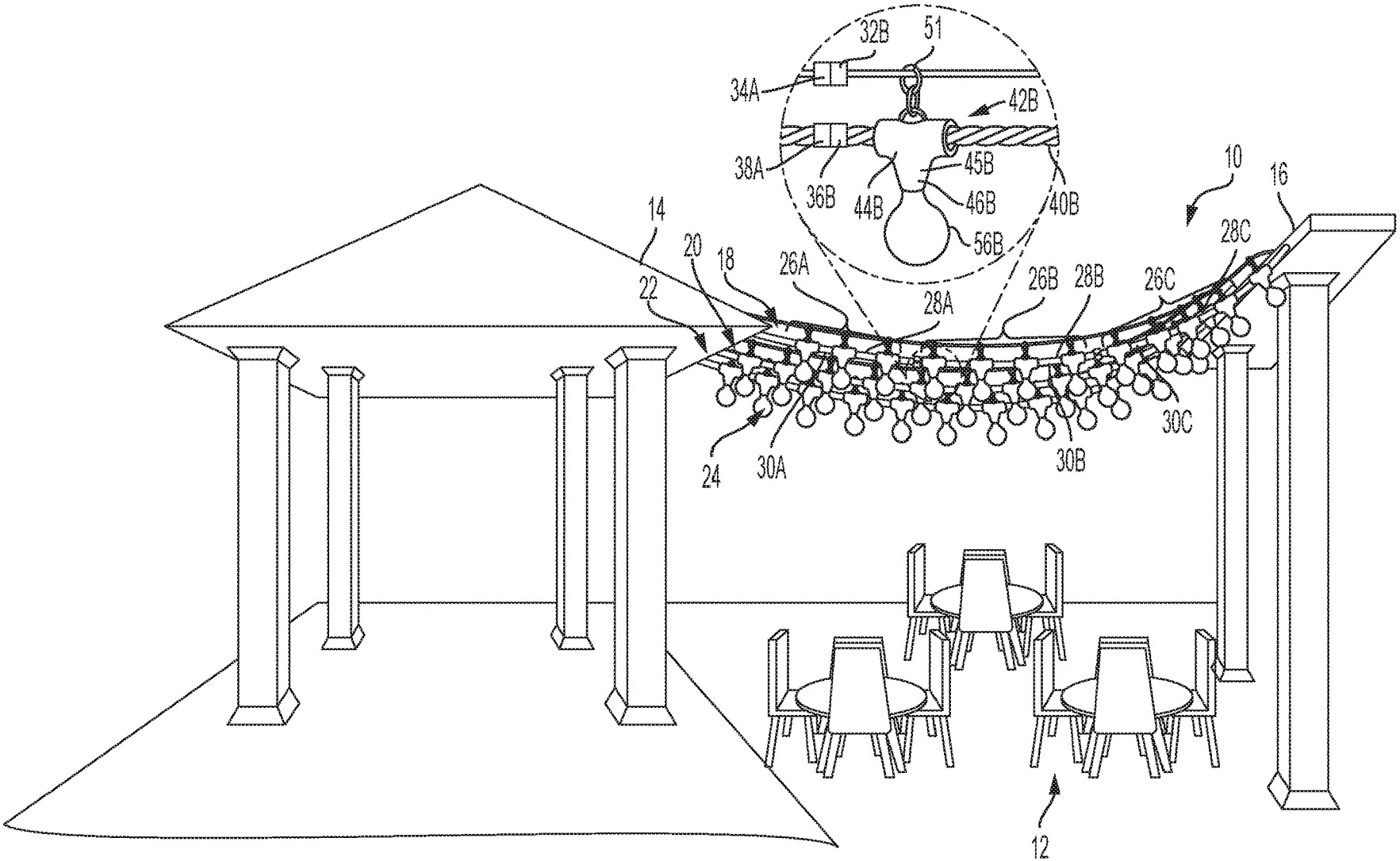
FIG. 1 is a perspective view of adaptable and secure café lighting suspended over an exemplary venue.

FIG. 1 is a perspective view of adaptable and secure café lighting suspended over an exemplary venue. In FIG. 1, Café lighting system 10 is suspended over outdoor cafeteria 12 between pavilion 14 and column support 16. Café lighting system 10 includes four lengths 18, 20, 22, and 24, each suspended by and between pavilion 14 and column support 16. Each of lengths 18, 20, 22, and 24 have substantially the same longitudinal dimension as they are suspended from the same structural support members—pavilion 14 and column support 16. In other venues or configurations, the various lengths of a café lighting system might have longitudinal dimensions different from one another or a single length might constitute the café lighting system.

Each of lengths 18, 20, 22, and 24 includes one or more café lighting sections, interconnected to one another so as to form the length. For example, length 18 has café lighting sections 26A, 26B, and 26C. Each of café lighting sections 26A, 26B, and 26C includes structural support cable 28A, 28B, and 28C and café light string 30A, 30B, and 30C, respectively. Interconnection of café lighting sections 26A, 26B, and 26C of length 18 can be performed by interconnecting structural support cables 28A, 28B, and 28C to one another and interconnecting café light strings 30A, 30B, and 30C to one another.

Interconnecting structural support cables 28A, 28B, and 28C to one another includes mechanically securing adjacent ends of adjacent structural support cables 28A and 28B to one another and mechanically securing adjacent ends of adjacent structural support cables 28B and 28C to one another. Structural support cables 28B has first connecting member 32B at a first end of structural support cable 28B. First connecting member 32B is configured to mechanically connect to second connecting member 34C at a second end of structural support cable 28C, which is adjacent and upstream thereto. Structural support cables 28B has second connecting member 34B at a second end of structural support cable 28B. Second connecting member 34B is configured to mechanically connect to first connecting member 32C at a first end of structural support cable 28A, which is adjacent and downstream thereto. Structural support cables 28A and 28C are configured in a similar fashion as structural support cable 28B, even though only connected to one adjacent structural support cable—structural support cable 28B.

Interconnecting café light strings 30A, 30B, and 30C to one another includes connecting electrical connectors at adjacent ends of adjacent café lighting strings 30A and 30B to one another and connecting electrical connectors at adjacent ends of adjacent café lighting strings 30B and 30C to one another. Café light string 30B has first electrical connector 36B at a first end of café light string 30B. First electrical connector 36B is electrically connect to second electrical connector 38C at a second end of café light string 30C, which is adjacent and upstream thereto. Café light string 30B has second electrical connector 38B at a second end of café light string 30B. Second electrical connector 38B is electrically connect to first electrical connector 38A at a first end of café light string 30A, which is adjacent and downstream thereto. Café light strings 30B also has an electrical cable 40B extending between first and second electrical connectors 36B and 38B. Café light strings 30A and 30C are configured in a similar fashion as café light strings 30B, even though only connected to one adjacent café light strings—café light strings 30B.

Each of café light strings 30A, 30B, and 30C can further include a plurality of café lighting taps 42. Each of the lighting taps 42 can include one or more of the following: i) a cable coupler; ii) a light socket; iii) a pigtail cable; and iv) a light emitting device. As depicted in FIG. 1, lighting tap 42B includes cable coupler 44B, pigtail cable 46B, light socket 48B and light emitting device 50B. Cable coupler 44B is configured to provide electrical power conducted by electrical cable 40B to any connected lighting element, such as lighting element 50B. Lighting element 50B is electrically and mechanically coupled to pigtail 42B via light socket 48B. pigtail cable 46B conducts the electrical power form cable coupler 44B to light socket 48B.

Each of lengths 18, 20, 22, and 24 will have a tensile force applied thereto due to the force required to suspend each length 18, 20, 22, and 24 in its corresponding suspension configuration. Many electrical connectors, such as electrical connectors 32A and 32B, are not configured to maintain good electrical connection therebetween in high tensile situations. Furthermore, applying large tensile forces to electrical elements, such as café light strings 30A, 30B, and 30C, can cause failure of such electrical elements. Therefore, controlling a tensile force applied to interconnected café light strings 30A, 30B, and 30C can facilitates reliability of electrical power provided to the café lights of interconnected café light strings.

Café light string 30B is slidably coupled to structural support cable 28B so as to slidably extended along the structural support cable between first and second mechanical connecting members 32B and 34B of the structural support member 28B. In the depicted embodiment, slidable coupler 52B of lighting tap 42B provides slidable coupling between café light string 30B and structural support member 28B. In other embodiments, slidable couplers need not be associated with lighting taps, such as lighting tap 42B. A series of slidable coupling members can be distributed along café light string 30B. In some embodiments, structural support cable 28B can include first and second retention features configured to retain the plurality of slidable couplers of café light string 30B between first and second connecting members 32B and 34B, respectively, of structural support cable 28B.

To control tensile forces applied to interconnected café light strings 30A, 30B, and 30C, structural support cable 28A, 28B, and 28C have cable lengths that are less than string lengths of café light strings 30A, 30B, and 30C. Such control of cable and string lengths permit tension to be applied to the interconnected structural support cables 28A, 28B, and 28C without such high tension being simultaneously applied to interconnected café light strings 30A, 30B, and 30C.

Figure 2:
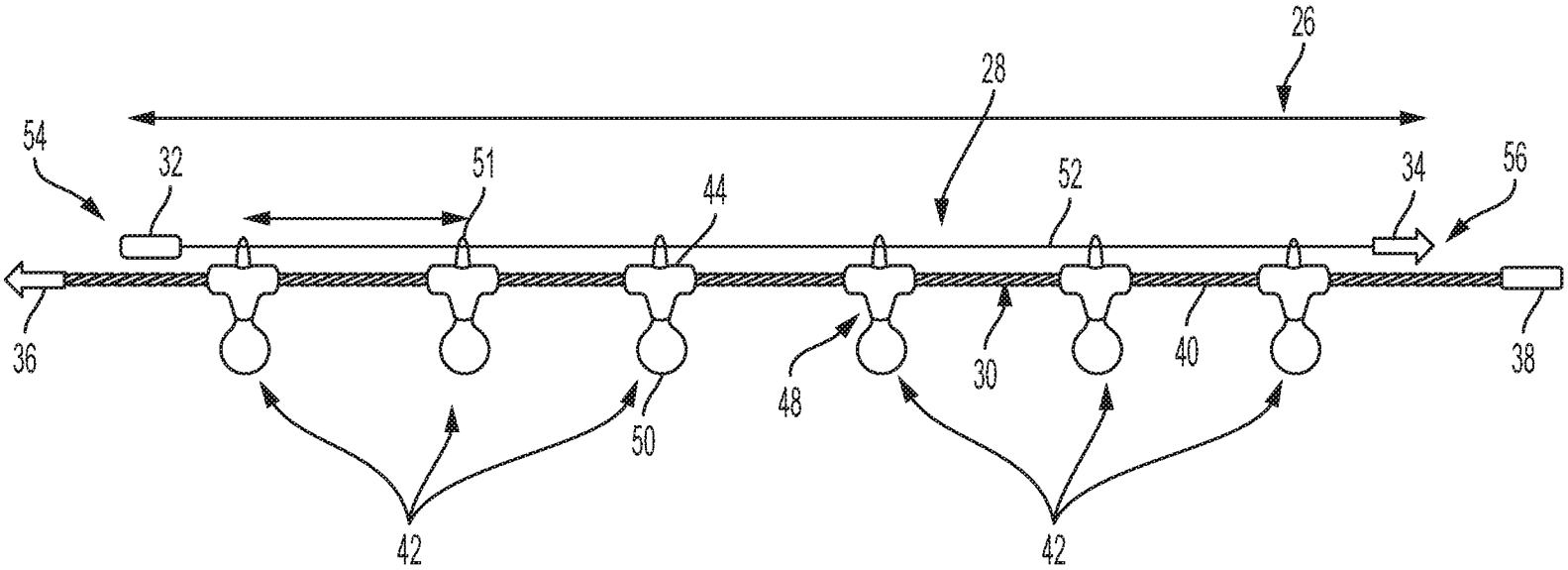
FIG. 2 is a schematic view of an embodiment of a café lighting section having a suspension cable and café light string slidably coupled to one another.

FIG. 2 is a schematic view of an embodiment of a café lighting section having a suspension cable and café light string slidably coupled to one another. In FIG. 2, café lighting section 26 includes structural support cable 28 and café light string 30. Structural support cable 28 includes high-tensile-strength cable 52, first connecting member 32 at first end 54 of structural support cable 28, and second connecting member 34 at second end 56 of structural support cable 28. First and second connecting members 32 and 34 are configured to releasably connect to one another (so as to facilitate daisy-chain connection of a series of interconnected structural support members). In some embodiments, first and second connecting members 32 and 34 can be pin secured couplers, for example. In some embodiments, first and second connecting members 32 and 34 can be rotationally secured couplers. In some embodiments, the coupler can have a detent to indicate secure and/or to lock coupling of first and second connecting members. Various other types of mechanical connectors can be used as well as many such types of mechanical connectors are known in the art. In some embodiments, first and second connecting members can also function as first and second retention features configured to retain the plurality of slidable couplers of café light string 30 between first and second connecting members 32 and 34, respectively, of structural support cable 28.

Figure 3:
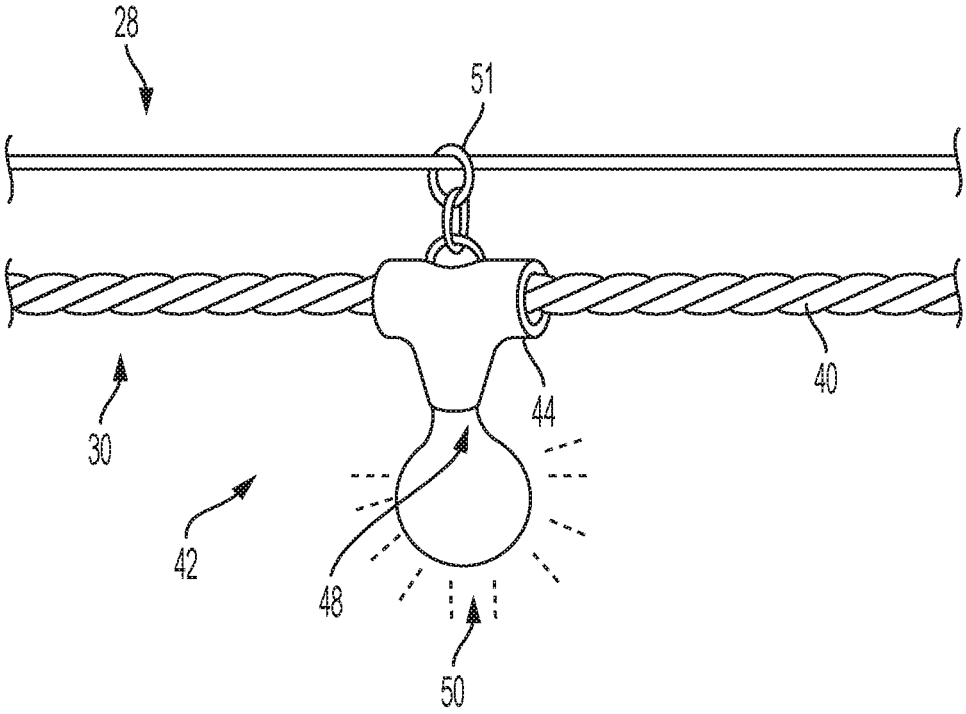
FIG. 3 is a schematic view of a single café lighting tap of the café lighting system depicted in FIG. 2.

Each of lighting taps 42 includes cable coupler 44, light socket 48, light emitting device 50, and slidable coupler 52. Lighting tap 42 is depicted in closeup fashion in FIG. 3. FIG. 3 is a schematic view of a single café lighting tap of the café lighting system depicted in FIG. 2. Café light string 30 includes electrical cable 40, first electrical connector 36 at first end 58 of café light string 30, second electrical connector 38 at second end 60 of café light string and lighting taps 42 distributed along café light string 30. First and second electrical connectors 36 and 38 are configured to releasably connect to one another (so as to facilitate daisy-chain connection of a series of interconnected café light strings). In some embodiments, first and second connecting members 32 and 34 can be pin or blade and socket connectors, for example. Various other types of electrical connectors can be used as well as many such types of electrical connectors are known in the art.

Various types of light emitting devices can be used. For example, incandescent, fluorescent bulbs can be used. In some embodiments, light emitting diodes (LEDs) can be used as light emitting devices 42. Light sockets 48 are configured to receive the type of light emitting device for which café light string 30 is configured. In some embodiments, cable length of structural support cable 28, when in tensile condition (such as when supporting café light section 26) is substantially equal to string length of café light string 30 under substantially no tension. In other embodiments the cable length of structural support cable 28 is less than the string length of café light string 30. For example, in some embodiments, a ratio of cable length to string length is less than 0.99, 0.98, 0.95 or 0.93, for example.

Figure 4:
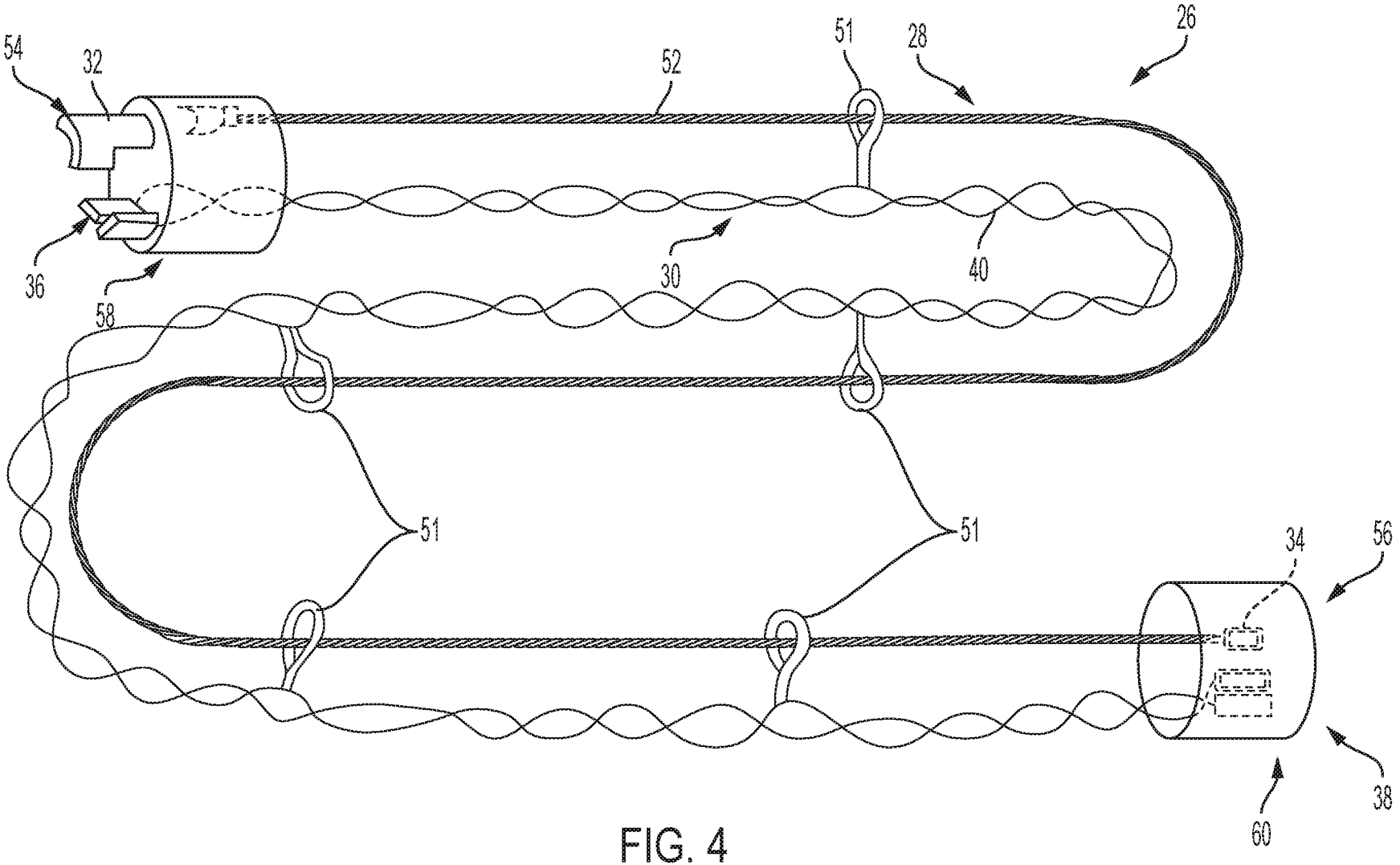
FIG. 4 is a schematic view of another embodiment of a café lighting section having a suspension cable and café light string coupled to one another.

FIG. 4 is a schematic view of another embodiment of a café lighting section having a suspension cable and café light string coupled to one another. In FIG. 4, café lighting section 26 includes structural support cable 28 and café light string 30. Structural support cable 28 includes high-tensile-strength cable 52, first connecting member 32 at first end 54 of structural support cable 28, and second connecting member 34 at second end 56 of structural support cable 28. In the depicted embodiment, first and second connecting members 32 and 34 include manual fasteners (e.g., a tab rotational secured to an aperture). Café light string 30 includes electrical cable 40, first electrical connector 36 at first end 58 of café light string 30, second electrical connector 38 at second end 60 of café light string and lighting taps (not depicted) distributed along café light string 30. In the depicted embodiment, the first and second manual fasteners are combined with first and second electrical connectors, respectively, as first and second unitary body connectors.

Café lighting section 26 further includes a plurality of coupling members 51 that provide coupling between the café light string and the structural support cable. In some embodiments, the coupling members can provide slidable coupling between structural support cable 28 and café light string 30. In such embodiments, a string length of light string 30 is greater than or equal to a cable length of structural support cable 28, so as to ensure that tensile forces associated with suspension of café lighting section 26 are borne primarily by structural support cable 28 and not by light string 30. In other embodiments, the coupling members can provide fixed coupling between structural support cable 28 and café light string 30. In such embodiments, a string section lengths of light string 30 between adjacent coupling members 51 are greater than or equal to corresponding cable section lengths of structural support cable 28 between the adjacent coupling members 51, so as to again ensure that tensile forces associated with suspension of café lighting section 26 are borne primarily by structural support cable 28 and not by light string 30.

Figure 5:
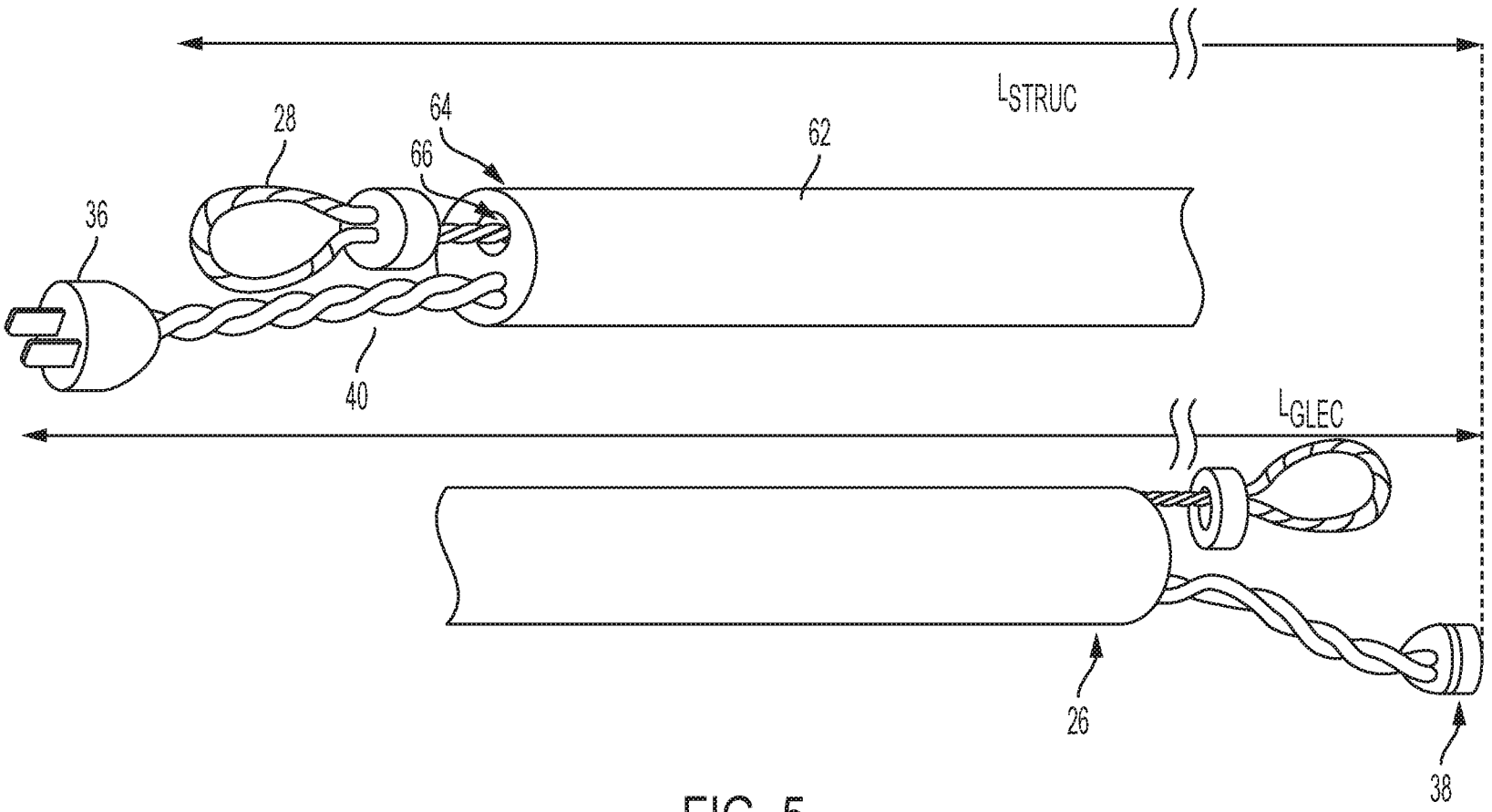
FIG. 5 is a perspective view of an embodiment café lighting section in which the electrical cable and the structural support cable share a common sheath.

FIG. 5 is a perspective view of an embodiment café lighting section in which the electrical cable and the structural support cable share a common sheath. In FIG. 5, café lighting section 26 includes sheath 62, which extends from first end 64 to a second end (not depicted). Sheath 62 slidably couples structural support cable 28 to electrical cable 40. Sheath 62 has a channel 66 (e.g., lumen) through which structural support cable 28 freely can travel. Sheath 62 can either be fixedly attached or slidably attached to electrical cable 40. To reduce tensile forces in electrical cable 40, a length dimensions $L_{ELEC}$ of electrical cable 40 is greater than a length dimensions $L_{STRUC}$ of structural support cable 26. Thus, when suspended, via structural support cable 28 over an expanse, tensile forces upon electrical connectors 36 and 38 will be small so as not to disconnect adjacent connected café lighting sections. Such an embodiment, as depicted in FIG. 5 provides visual simplicity, having only one apparent cable suspended across the expanse. Such visual simplicity is maintained over a sheath length $L_{SHEATH}$ of the sheath. A ratio of the sheath length $L_{SHEATH}$ to either of the length dimensions $L_{ELEC}$ of the length dimensions $L_{STRUC}$ can be greater than 0.90, 0.95, 0.97, or 0.99. In some embodiments, structural support cable 28 and electrical cable 40 can share an end connector, such as the first and second unitary body connectors depicted in the FIG. 4 embodiment.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A lighting section comprising:

a structural support cable including:

a first connecting member at a first end of the structural support cable and configured to mechanically connect to a second connecting member at a second end of an adjacent upstream structural support cable; and a second connecting member at a second end of the structural support cable and configured to mechanically connect to a first connecting member at a first end of an adjacent downstream structural support cable; and a light string slidably coupled to the structural support cable at a plurality of locations distributed along the light string so as to be slidably extended along the structural support cable between the first and second connecting ends of the structural support cable, the light string including:

a first electrical connector at a first end of the light string and configured to receive electrical power from a second electrical connector of an adjacent upstream café light string;

a second electrical connector at a second end of the light string and configured to provide electrical power to a first electrical connector of an adjacent downstream café light string; and an electrical cable extending between the first and second electrical connectors.

2. The lighting section of claim 1, wherein the electrical cable extending between the first and second electrical connectors is configured to conduct the electrical power so as to provide the electrical power received by the first electrical connector to the second electrical connector.

3. The lighting section of claim 1, wherein the light string further comprises a plurality of lighting taps distributed along the light string.

4. The lighting section of claim 3, wherein each of the plurality of lighting taps includes:

a cable coupler providing slidably coupling to the structural support cable.

5. The lighting section of claim 3, wherein each of the plurality of lighting taps includes:

a light socket configured to removably couple to an illumination device.

6. The lighting section of claim 5, wherein each of the plurality of lighting taps further includes:

a pigtail cable extending between the electrical cable and the light socket and configured to receive electrical power from the electrical cable and to provide such electrical power received to the light socket.

7. The lighting section of claim 5, wherein each of the plurality of lighting taps further includes:

the illumination device removably coupled to the light socket.

8. The lighting section of claim 7, wherein the illumination device is a café light.

9. The lighting section of claim 7, wherein the illumination device comprises a light emitting diode (LED).

10. The lighting section of claim 1, wherein a cable length of the structural support cable, as measured between the first and second connecting ends, is less than or equal to a string length between the first and second electrical connectors, thereby permitting tension to be applied to the structural support cable without such high tension being simultaneously applied to the light string.

11. The lighting section of claim 1, wherein the cable length of the structural support cable, as measured between the first and second ends, is less than the string length between the first and second electrical connectors.

12. The lighting section of claim 1, further comprising:

an adjustable length structural securing device configured to couple to either the first or second connecting ends of the structural support cable so as to secure the first or second connecting ends connected to a structural support member.

13. The lighting system of claim 1, wherein the light string is slidably coupled to the structural support cable.

14. The lighting section of claim 13, further comprising a plurality of coupling members that provide slidable coupling between the light string and the structural support cable.

15. The lighting section of claim 14, wherein the plurality of coupling members is distributed along the light string, each fixedly coupled thereto.

16. The lighting section of claim 14, where each of the plurality of coupling members includes an aperture through which the structural support cable passes.

17. The lighting section of claim 14, wherein the structural support cable further includes:

first and second retention features configured to retain the plurality of cable couplers of the light string between the first and second connecting ends, respectively, of the structural support cable.

18. The lighting section of claim 1, wherein each of the first connecting end includes a first manual fastener, and the second connecting end includes a second manual fastener complementary to the first manual fastener.

19. The lighting section of claim 18, wherein the first and second manual fasteners are combined with first and second electrical connectors, respectively, as first and second unitary body connectors.

20. The lighting section of claim 1, wherein the first and second electrical connectors, when connected to one another form a waterproof barrier to electrical contacts thereof.

* * * * *